US008789344B2

(12) United States Patent
Monti

(10) Patent No.: US 8,789,344 B2
(45) Date of Patent: Jul. 29, 2014

(54) CAPPING DEVICE

(75) Inventor: Giuseppe Monti, Pianoro (IT)

(73) Assignee: Marchesini Group S.p.A., Pianoro (BO) (IT)

( * ) Notice: Subject to any disclaimer, the term of this patent is extended or adjusted under 35 U.S.C. 154(b) by 716 days.

(21) Appl. No.: 13/100,712

(22) Filed: May 4, 2011

(65) Prior Publication Data

US 2011/0271642 A1 Nov. 10, 2011

(30) Foreign Application Priority Data

May 5, 2010 (IT) ..... BO2010A0286

(51) Int. Cl.

| | |
|---|---|
| ***B65B 1/04*** | (2006.01) |
| ***B65B 7/28*** | (2006.01) |
| ***B67B 1/04*** | (2006.01) |
| *B65B 3/00* | (2006.01) |

(52) U.S. Cl.

CPC ..... *B65B 7/2821* (2013.01); *B65B 3/003* (2013.01); *B67B 1/04* (2013.01)

USPC ..... 53/319; 53/306; 53/307; 53/324

(58) Field of Classification Search

CPC ..... B65B 7/2807; B65B 7/2821; B67B 1/00; B67B 1/005; B67B 1/03; B67B 1/04; B67B 2201/01; B67B 2201/012; B67B 2201/08; A61J 1/1406

USPC ..... 53/299, 306, 307, 310–312, 319, 324, 53/328

See application file for complete search history.

(56) References Cited

U.S. PATENT DOCUMENTS 2,934,238 A * 4/1960 Henderson et al. ..... 221/36
3,282,026 A * 11/1966 Cozzoli et al. ..... 53/306

(Continued)

FOREIGN PATENT DOCUMENTS

DE 19937011 A 2/2001
EP 1970306 A 9/2008

OTHER PUBLICATIONS

European Search Report for EP application 11 16 4734, dated Aug. 29, 2011, 2 pages.

*Primary Examiner* — Thanh Truong
*Assistant Examiner* — Eduardo R Ferrero
(74) *Attorney, Agent, or Firm* — William J. Sapone; Ware Fressola Maguire & Barber LLP

(57) ABSTRACT

A capping device for capping vials borne by a respective conveyor (101), with caps (3) which include an inserting portion (31), shaped for insertion into a mouth of the vial (2) and a head portion (32), which remains externally on the vial (2) after capping. The capping device (1) includes a pick-up zone (12) configured for supporting and containing the caps (3) to be picked up by contacting only the head portion (32) thereof, a conveyor (11) for supplying caps (3) to the pick-up zone (12), configured to carry the caps (3) by contacting only a head portion (32) thereof; and a pick-up and inserting device (13) configured and activatable for picking up at least one cap (3) at a time from the pick-up zone (12), contacting only the head portion (31), and for holding the cap only by the head portion (302) while transporting the cap to a respective vial (2), and then inserting at least a part of the inserting portion (301) into the mouth of the vial (2).

20 Claims, 4 Drawing Sheets

(56) References Cited

U.S. PATENT DOCUMENTS

| | | | | | |
|---|---|---|---|---|---|
| 3,414,111 | A * | 12/1968 | Ernest | 198/391 |
| 3,453,804 | A * | 7/1969 | Bott et al. | 53/264 |
| 3,527,017 | A * | 9/1970 | Bott et al. | 53/500 |
| 3,634,997 | A * | 1/1972 | Tait | 53/127 |
| 3,855,749 | A * | 12/1974 | McMickle, Jr. | 53/306 |
| 4,266,653 | A * | 5/1981 | Mergl | 198/392 |
| 4,355,495 | A * | 10/1982 | Lewis et al. | 53/579 |
| 4,533,515 | A * | 8/1985 | Witter et al. | 422/26 |
| 5,284,001 | A * | 2/1994 | Ochs | 53/307 |
| 5,301,488 | A * | 4/1994 | Ruhl et al. | 53/55 |
| 5,493,849 | A * | 2/1996 | Itoh | 53/489 |
| 6,199,350 | B1 * | 3/2001 | Brechel et al. | 53/510 |
| 6,631,799 | B2 * | 10/2003 | Samson | 198/771 |
| 7,735,297 | B2 * | 6/2010 | Monti | 53/329 |
| 8,397,473 | B2 * | 3/2013 | Pedrazzini | 53/317 |
| 2005/0236255 | A1 * | 10/2005 | Minami et al. | 198/339.1 |
| 2006/0075721 | A1 * | 4/2006 | Monti | 53/167 |
| 2007/0234682 | A1 * | 10/2007 | Monti | 53/358 |
| 2008/0184668 | A1 * | 8/2008 | Monti | 53/53 |
| 2008/0223003 | A1 * | 9/2008 | Monti | 53/281 |
| 2011/0271642 | A1 * | 11/2011 | Monti | 53/319 |
| 2011/0302883 | A1 * | 12/2011 | Monti | 53/281 |

* cited by examiner

CAPPING DEVICE

FIELD OF THE INVENTION

The present invention relates to automatic machines for packing vials, bottles or other like containers.

In particular, the invention relates to capping devices incorporated in the automatic machines.

DESCRIPTION OF THE PRIOR ART

Automatic machines for packing vials provide at an outlet thereof vials that are already capped and filled, for example with liquids or powder substances or capsules, or other items.

In these machines, special filling devices fill the vials which are then conveyed to capping devices.

Capping devices cap the full vials, using caps which are supplied in an inlet to the capping devices.

Thereafter, the full and capped vials are conveyed to other stations, or to further devices of the machine, for completion of the packaging.

A cap of known type, much used in closing such vials, is the mushroom-shaped cap.

This cap comprises an inserting portion, having a shape that is similar to a mushroom stalk, destined to be inserted in the neck of a vial through the mouth thereof, and a head portion, similar to a mushroom head, destined to remain external of the vial even after capping.

The mushroom cap has transversal dimensions that are different in the inserting portion and the head portion. The cap is narrower in the inserting portion than in the head portion.

In the case in which the vials to be packed are to be filled with pharmaceutical substances, it would be preferable that the inside of the vials were completely sterile before being filled and remained so even after capping, for obvious sanitary reasons.

In part, this can be attained by using laminar flows of sterile air which strike the inside of the vials, passing through the mouth, before and after filling.

In order to have the certainty of sterility inside the vials, it is necessary that the inserting portion of the caps be sterile at the moment of insertion thereof into the mouth of the vial during closure.

Striking the inserting portion with laminar flows of sterile air is not in itself sufficient to guarantee the internal sterility of the capped vials.

The capping devices of known type comprise means for picking up the caps and applying them to the vial mouths, which are configured in such a way that during activation thereof the inserting portion of the picked-up caps enters into contact with the surfaces of the device, whose total sterility cannot be guaranteed.

It is not in fact possible to permanently cause laminar flows of sterile air to invest all the surfaces of the capping devices with which the inserting portion of the caps enters into contact.

Thus, the inserting portion of the caps, even if made sterile by laminar flows of sterile air, might lose sterility wholly or partially through contact with the surfaces of the capping device, immediately before being inserted in the vial, which renders the use of sterile air flows not completely effective.

SUMMARY OF THE INVENTION

The aim of the present invention is to disclose a capping device which guarantees that totally sterile inserting portions of caps supplied to the device do not lose this total sterility during their collection and application to the vial mouths, for total or partial closure thereof.

This aim is attained by a capping device for capping vials borne by a respective conveyor with a mouth facing upwards, by means of caps which comprise an inserting portion, shaped so as to be inserted in one of the vials via the mouth of the vials, and a head portion destined to stay outside the vial even after capping.

The capping device of the invention comprises:

- a pick-up zone configured for supporting and containing the caps to be picked up, contacting the caps only at the head portion thereof;
- conveyor means for supplying the caps to the pick-up zone, configured for carrying the caps, while contacting the caps only at the head portion thereof; and
- pick-up and inserting means for picking up at least one cap at a time from the pick-up zone, contacting only the head portion, so as to transport the picked-up cap, while retaining it only by its head portion, to a respective vial to be capped, which is borne by the conveyor, and to insert at least a part of the inserting portion of the cap into the vial, via the mouth.

If the caps supplied in the inlet to the capping device have the inserting portion totally sterile, or the portion is sterilized when the caps are borne by the conveyor means of the device, the use of the proposed capping device provides an absolute guarantee of the fact that the inserting portion of the cap has remained totally sterile.

Consequently, the capping operation does not even partially compromise the sterility of the inside of the vials.

The invention can obtain this result thanks to the fact that the structure and functioning of the essential elements which interact with the caps are such that they are always supported, transported and lastly applied to the vials without the inserting portions contacting any part of the capping device.

In fact, each time the capping device of the invention interacts with the caps provided to it, the capping device contacts them always and only by the head portion thereof.

As the head portion of a cap is the part that remains external of the vial even after capping, there can be no compromise of the sterility of the inside of the capped vials by the use of the capping device.

It is therefore clear that the capping device, although specially developed for capping vials, in particular for containing pharmaceutical substances, can be used for capping bottles or other containers as long as they exhibit an access to the inside thereof which is equivalent to a mouth.

BRIEF DESCRIPTION OF THE DRAWINGS

Specific embodiments of the invention, and advantageous technical-functional characteristics correlated to the embodiments only in part derivable from the above description, will be described in the following description, in accordance with what is set out in the claims and with the aid of the accompanying figures of the drawings, in which:

DESCRIPTION OF THE PREFERRED EMBODIMENTS

Figure 1:
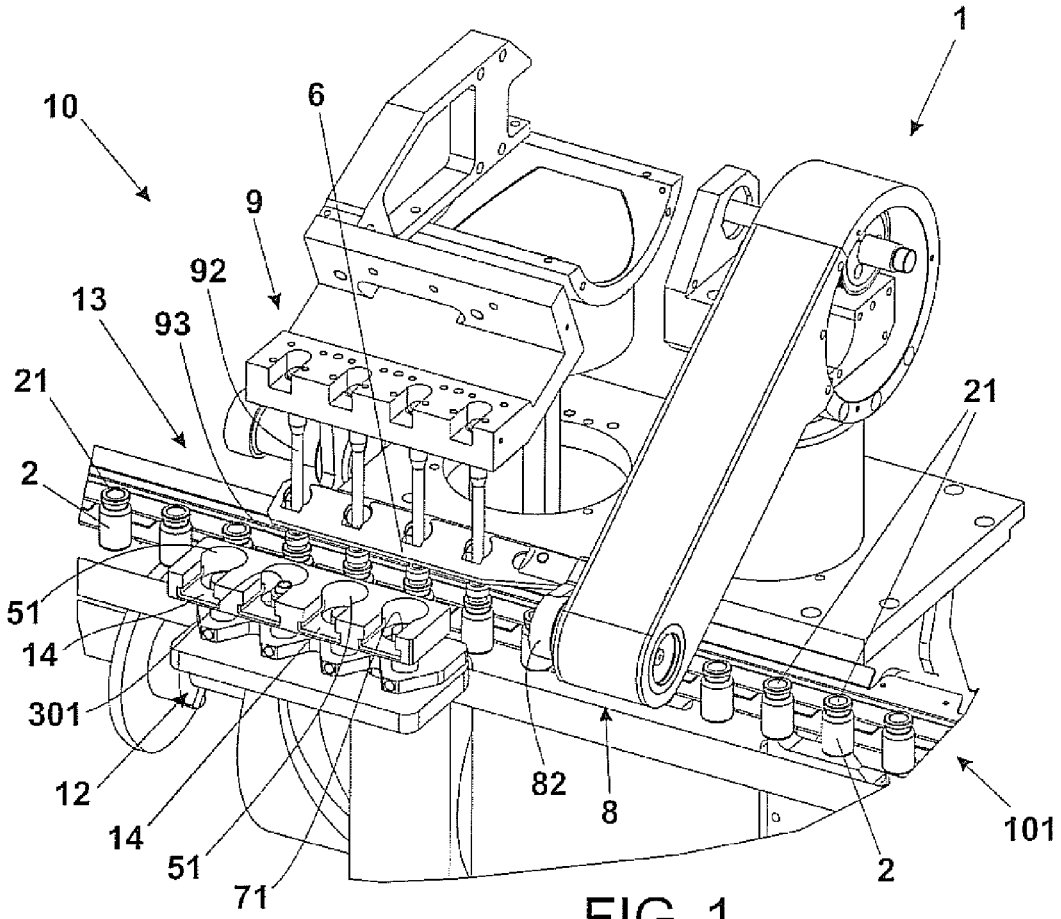
FIG. 1 is an axonometric view of the capping station comprising the capping device of the invention.
Figure 6:
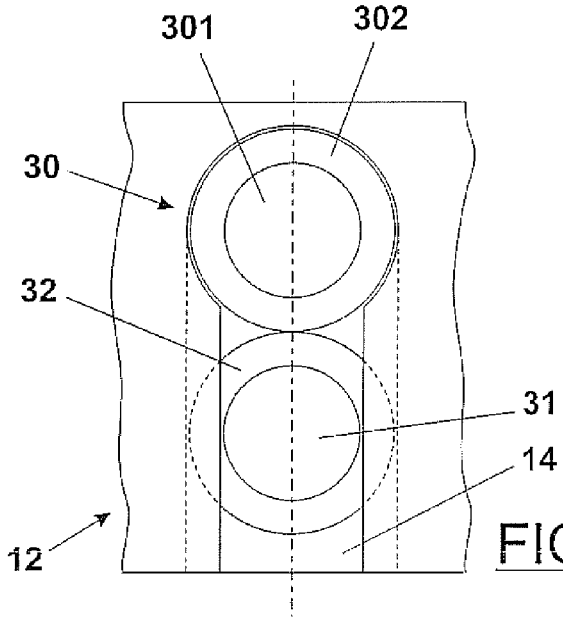
FIG. 6 is a schematic plan view of a pick-up zone of the capping device.

With reference to the appended tables of drawings, 1 denotes the capping device of the invention.

The device 1 is specially destined to be part of a capping station 100 (shown in FIG. 1) in an automatic machine for packing vials 2.

Therefore, the device 1 is in particular an automatic device.

The station 100 can comprise a vibrator surface 102 for supplying the conveyor means 11 of the device 1 with caps 3.

Further, the station can comprise the conveyor 101, activatable for example with step-advancement, for conveying the vials 1 in one or more linear rows.

The linear row of the vials 2 can be perpendicular to the conveying direction of the caps 3 from the vibrator surface 102 to the capping device 1, the transporting being carried out by the conveyor means 11.

The capping device 1 is between the vibrator surface 102 and the vials 2 which cross the capping station 100 on the conveyor 101 thereof, normally with the mouths 21 facing upwards.

The task of the device 1 is to cap the vials with caps 3, the inserting portions of which are sterile when inserted at least partly in the vials 2.

The device can be activated so as to cap vials 2 when the vials are kept stationary by the step conveyor 101.

In order for the inserting portions 31 of the caps 3 to reach the device 1 in a totally sterile state, means (not illustrated) can be provided in the capping station 100 that produce laminar flows of sterile air to strike the inserting portions 31 of the caps 3, at least during the transport of the caps by the conveyor means 11.

It is clear that other laminar flows of sterile air can be produced internally of the station 100.

As made clear herein above, the conveyor means 11 are configured so as to be able to carry the caps 3 while contacting them only at the respective head portion 32; therefore the transport on the conveyor will not endanger the sterility obtained using the above-cited laminar flows.

The conveyor means 11 preferably comprise at least a linear vibrator 4 which is configured for carrying the caps 3 resting on the head portion 32 thereof, with the respective inserting portions 31 facing upwards.

Therefore the laminar flows can be completely effective, for example if directed from above in a downwards direction.

The linear vibrator 4 is configured so as to advance the caps 3 towards the inside of the device 1, in at least a linear row 300, in which the caps 3 are adjacent to one another, into the pick-up zone 12, up to a stop surface 5, against which the head portion 312 of a first cap 310 of the linear row 300 abuts (see FIGS. 2, 3, 4 and 5).

The linear vibrator 4 not only advances the row 300 but also keeps the caps 3 of the row adjacent and pressed one against another, the caps 3 contacting one another by the head portions 32, at least after an initial transitory period.

When the first cap 310 of the row 300 abuts against the stop surface 5, the row 300 obviously halts because the second cap 320 presses against the first cap 310, which cannot advance beyond the stop surface 5, and the third cap presses against the stationary second cap, and so on.

In the following, we will make specific reference to caps 3 made in a mushroom shape, which are narrower in the inserting portion 31 than in the head portion 32.

This is because mushroom caps 3 are the most-used, and because some aspects of the preferred embodiment of the invention are designed especially for use with caps 3 made in this way.

Figures 2, 2A:
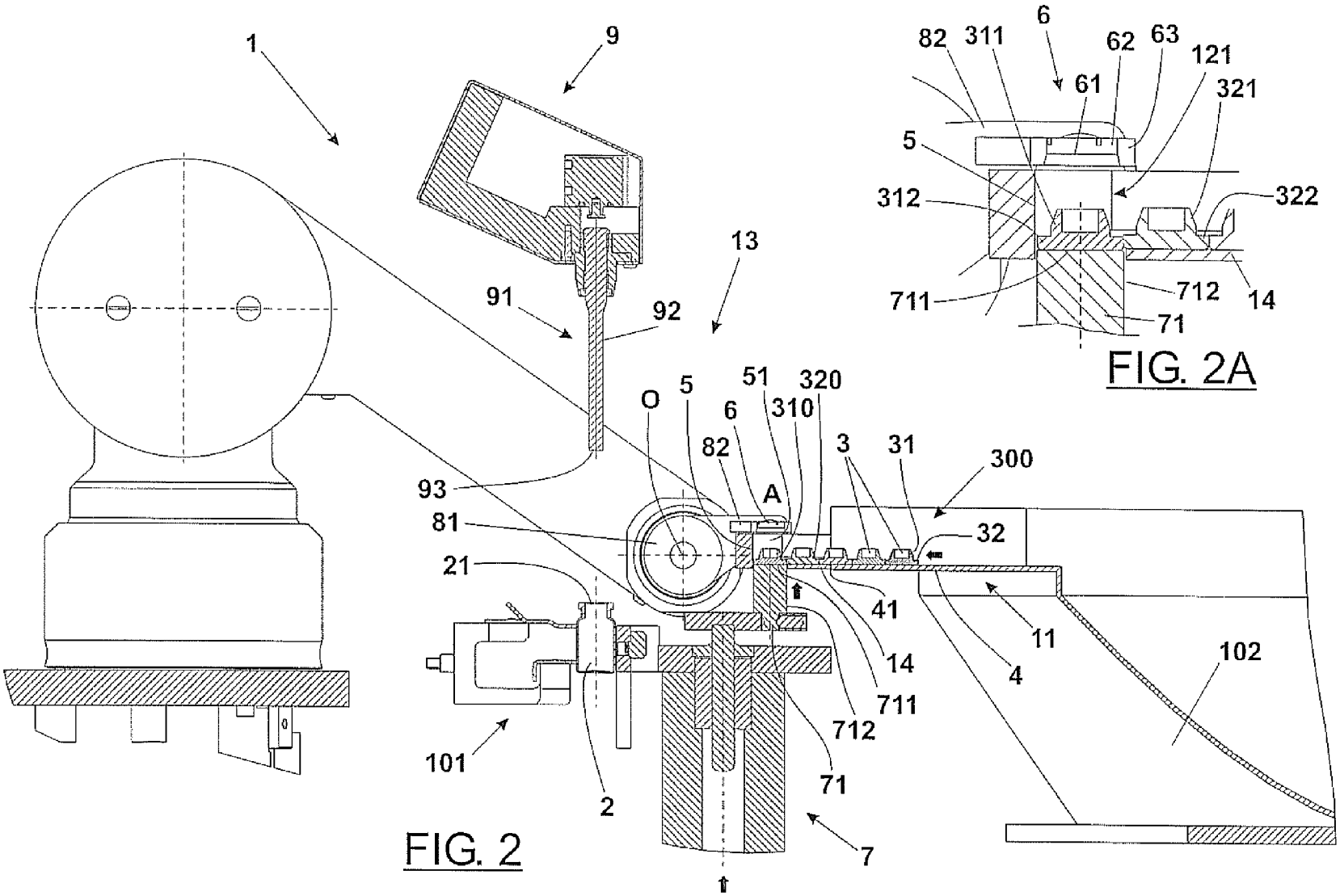
FIG. 2 is a lateral view in vertical section of the capping device.
FIG. 2A is a detail of FIG. 2, in which a housing for containing and carrying a cap is shown.
Figure 3:
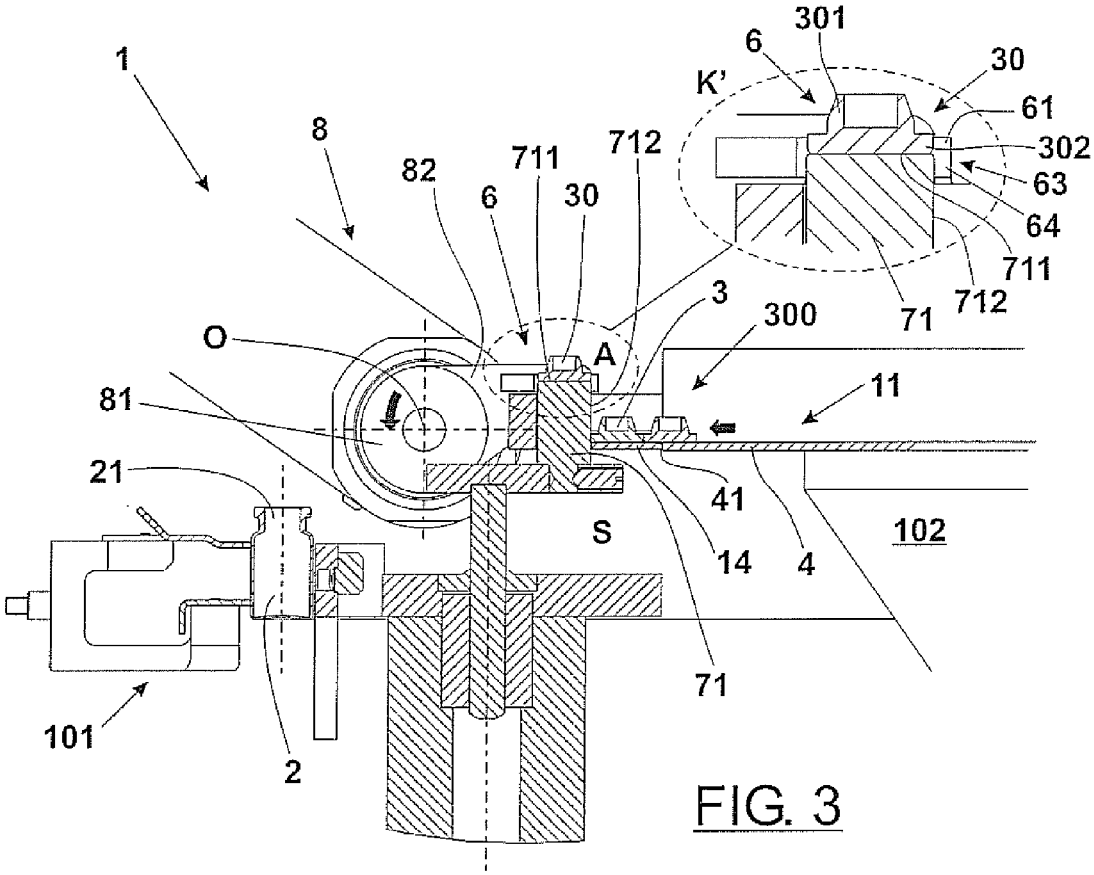
FIG. 3 is a partial lateral view, in vertical section, of the capping device with the housing in a receiving position for the cap, FIG. 3 also comprising an enlarged illustration, denoted K, of a detail of the capping device.
Figure 4:
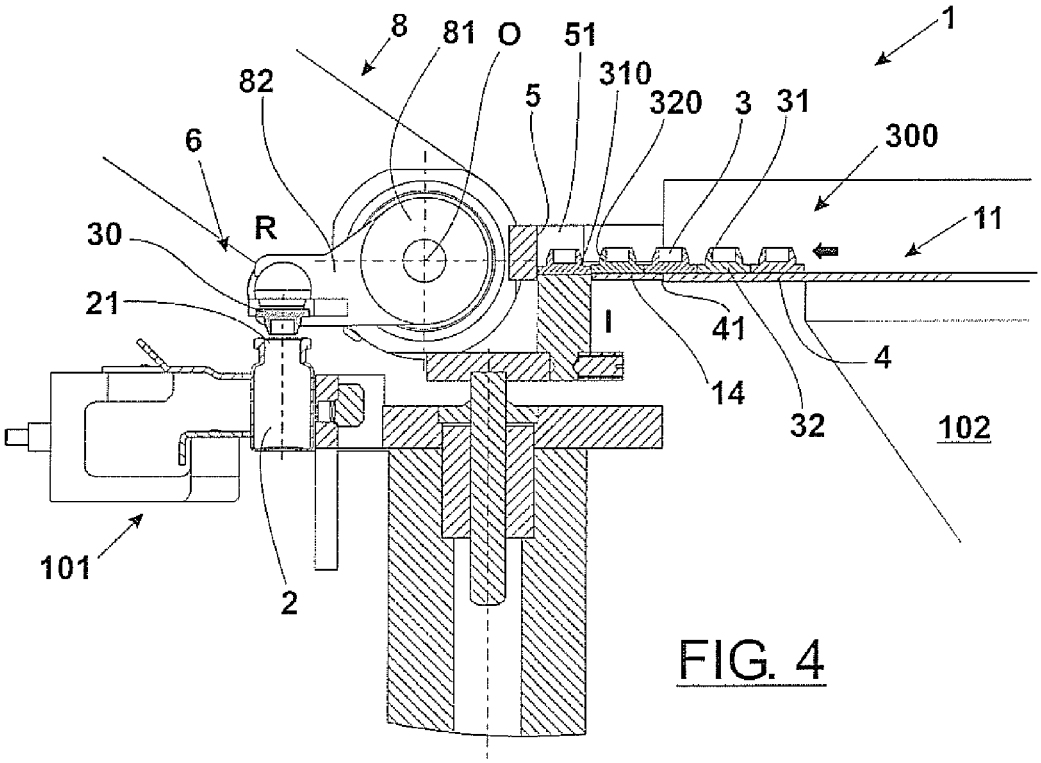
FIG. 4 is a partial lateral view, in vertical section, of the capping device with the housing in a release position for releasing the cap.

The pick-up zone 12 preferably comprises a pick-up point, denoted by 121 in FIGS. 2A, 3 and 4.

The pick-up point 121 is located between a more internal end 41 of the linear vibrator 4 (see for example FIGS. 1 and 2) and the stop surface 5.

The pick-up point 121 is actually the point the caps 3 reach and stop at; the caps 3 having to be picked up in order to be applied to the vials 2.

The linear vibrator 4, the stop surface 5 and the pick-up point 121 are reciprocally arranged such that the linear row of caps 300 is kept still both when the pick-up point 121 is occupied by the first cap 310, against the head portion 312 of which the head portion 322 of the adjacent second cap 320 abuts, and when the pick-up point 121 is occupied by an abutting element 71 (described in detail herein below) against which the head portion 322 of the second cap 320 abuts.

The row 300 remains stationary when the first cap 310 is at the pick-up point 121, so as to enable extraction thereof from the row 300, in order that the cap can be carried to a respective vial 2 to be capped.

Further, while the first cap 310 is being picked up, the row 300 remains stationary all the same thanks to the fact that the head portion 322 of the second cap abuts with a special abutting element 71 which is preferably a particular member 71 of a pick-up element 7 dedicated to extracting the first cap 310 from the row 300.

Therefore, with the above particulars, the sterility of the inserting portions 31 of the caps 3 is maintained, by means of a structure which does not create interference between the picking-up of various caps 3, without having to sacrifice high pick-up frequency, and all with the simplest possible architectural economy.

The linear vibrator 4, the stop surface 5 and the pick-up point 121 are further reciprocally arranged such that the linear row 300 advances when the pick-up point 121 is free from the caps 3 and from the abutting element 71, so as to enable the second cap 320, which in the meantime has become the new first cap 310, to be made available in the pick-up point 121 for a new extracting operation, and thus so as to cap another vial 2, and so on.

There follows a description, with the aid of FIGS. 2, 2A, 3, 4 and 5, and detail K, of the structure and functioning of the capping device 1 in the parts thereof which describe the picking-up, or extraction, of the caps 3 (i.e. the first caps 310) from the pick-up point 121, which parts also carry out the transference of the vials 2.

The pick-up and inserting means 13 primarily comprise at least a pick-up element 7 (already mentioned and described in detail above), positioned in the device so as to be able to pick up a cap 3 from the pick-up point 121, extracting it from the linear row 300.

In particular, the pick-up element 7 is configured to carry the cap 30 that has been picked up, contacting only the head portion 32 thereof.

Figure 7:
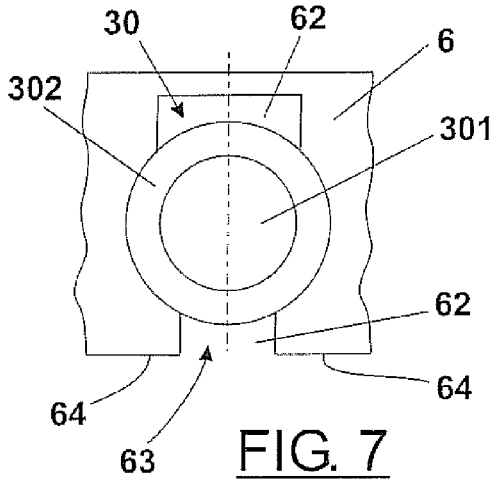
FIG. 7 is a partial schematic view from above of the housing illustrated in the preceding figures.

Further, the pick-up element 7 is activatable to pick up a cap 3 from the pick-up point 121 and to carry it and insert it into a housing 6, which is configured in such a way as to be able to accommodate the picked-up cap 30 and retain it releasably only by the head portion 302 thereof (see in particular FIGS. 2A and 7).

For the sake of clarity it is repeated that the housing 6 for the picked-up cap 30 can be arranged both in the receiving position A, in which it can receive the picked-up cap 30, and in a release position R, in which the cap 30, retained in the housing 6, is carried to the vial 2 in order to be applied thereto (in the ways which will be described herein below).

In the receiving position A, the housing 6 is located above the pick-up point 121, substantially superposed thereabove, and is arranged horizontally.

In the release position, the housing 6 is above the mouth 21 of a vial 2, and is arranged horizontally.

The pick-up element 7 preferably comprises a lifting member 71, arranged at the pick-up point 121, having a top 711 for supporting a cap 3 and a lateral surface 712.

The lifting member 71, as can be seen by comparing FIGS. 2, 3 and 4, is vertically movable between a lower position I, in which the top 711 can restingly receive the head portion 312 of the first cap 310 of the linear row 300 moved by the linear vibrator 4, and an upper arrangement S, wherein the first cap 310 which, as previously mentioned, occupies the pick-up point 121, is raised so as to be inserted in the housing 6 when the housing is in the receiving position A.

The top 711 of the lifting member 71 is shaped so as to lift the first cap 310, while contacting only the head portion 322 thereof.

For example, the top 711 can be flat and horizontal.

When the lifting member 71 is in the lower position I, the top 711 thereof is arranged with respect to the point of the pick-up zone 12 which supports the second cap 320, such that the head portion 322 of the second cap 320 is abutting only the head portion 312 of the first cap 310.

In detail, between the pick-up point 121 and the linear vibrator 4, as shown in the figures, there can be located an intermediate support 14 for the caps 3, on which the second cap 320 of the row 300 is located, among others.

The intermediate support 14, the top 711 of the lifting member 71 and the linear vibrator 4 can be coplanar.

The top 711 of the lifting member 71, when in the lower position I, could also be located below the intermediate support 14, which can be coplanar or be below the linear vibrator 4.

In any case, the reciprocal arrangement between these three elements is such that when the lifting member 71 is in the lower arrangement the caps 3 supported thereby, which are adjacent in the linear row 300, contact one another only by the respective head portion 32.

As mentioned above, the lifting member 71 constitutes the abutting element of the device 1, when the top 711 of the lifting member 71 is located above the linear vibrator 4.

In this way, the head portion 322 of the second cap 320 of the row 300 is abutting with the lateral surface 712 of the lifting member 71, which can be vertical.

In order to understand a particular aspect of the functioning of the extracting operation of the cap 310, which time by time occupies the pick-up point 121, a particular specification is required in the housing 6.

The housing 6 comprises an internal edge 61 which defines a through-hole 62 (as illustrated in FIGS. 2A and 7, for example, and in detail K), which through-hole 62 has larger dimensions that the width of the inserting portion 31 of a mushroom cap 3, the shape of the internal edge 61 and the dimensions of the through-hole 62 being such that the head portion 32 of a mushroom cap 3 can be received and retained by interference in the through-hole 62.

In this case, the lifting member 71 is activatable such that in the upper arrangement S thereof it raises the first cap 30, 310 so as to insert it in the through-hole 62 of the housing 6, when the housing 6 is in the receiving position A.

During the insertion, the inserting portion 302, 311 freely crosses the through-hole 62, and the cap 30, 310 contacts the internal edge 61 of the housing 6 only with the head portion 311.

To be absolutely certain that the inserting portion 302, 311 does not minimally contact any part of the device 1, and therefore does not touch the internal edge of the housing 6 either, and in order to be able to perform the extracting movement of the cap 31 from the row 300 with remarkable rapidity, the following specification can be included.

The device 1 can comprise a vertical guide 5, 51 located about the pick-up point 121, and shaped so that the internal walls thereof function as a lateral abutment to only the head portion 312 of the first cap 310 of the linear row 300, while it is raised by the pick-up element 7.

The vertical guide 5, 51 has an opening, facing towards the linear vibrator 4, of such dimensions so as to enable the caps 3 of the linear row 300 to access the pick-up point 121.

The vertical guide 5, 51 can have a height that is equal to the distance between the top 711 of the lifting member 71, when in the lower arrangement I, and the housing 6, when it is in the receiving position A.

Returning to the housing structure 6, the internal edge 61 can comprise a resilient elastic means, for example made of rubber and having a shape for releasably retaining, by interference, the head portion 32 of a cap 3.

This makes the releasable retaining function of the internal edge 61 even more efficient.

In still more detail, as the caps 3 usually have circular transversal sections, the internal edge 61 of the housing 6 is preferably constituted either by a cylindrical wall or by several walls located on the external surface of an ideal cylinder.

This enables a more solid abutment between the internal edge 61 and the external wall of the head portion 302 of the picked-up cap 30.

Thus, the elastic and resilient elastic means can be shaped as a ring or several ring sections.

As mentioned, the picked-up cap 30 retained in the housing 6 is then transferred to the vials 3, via a movement of the housing 6 itself.

For this purpose, a transfer mechanism 8 is comprised in the device 1, to which the housing 6 is fixed, activatable so as to move the housing 6 between the receiving position A and the release position (compare FIGS. 3 and 4).

Figure 5:
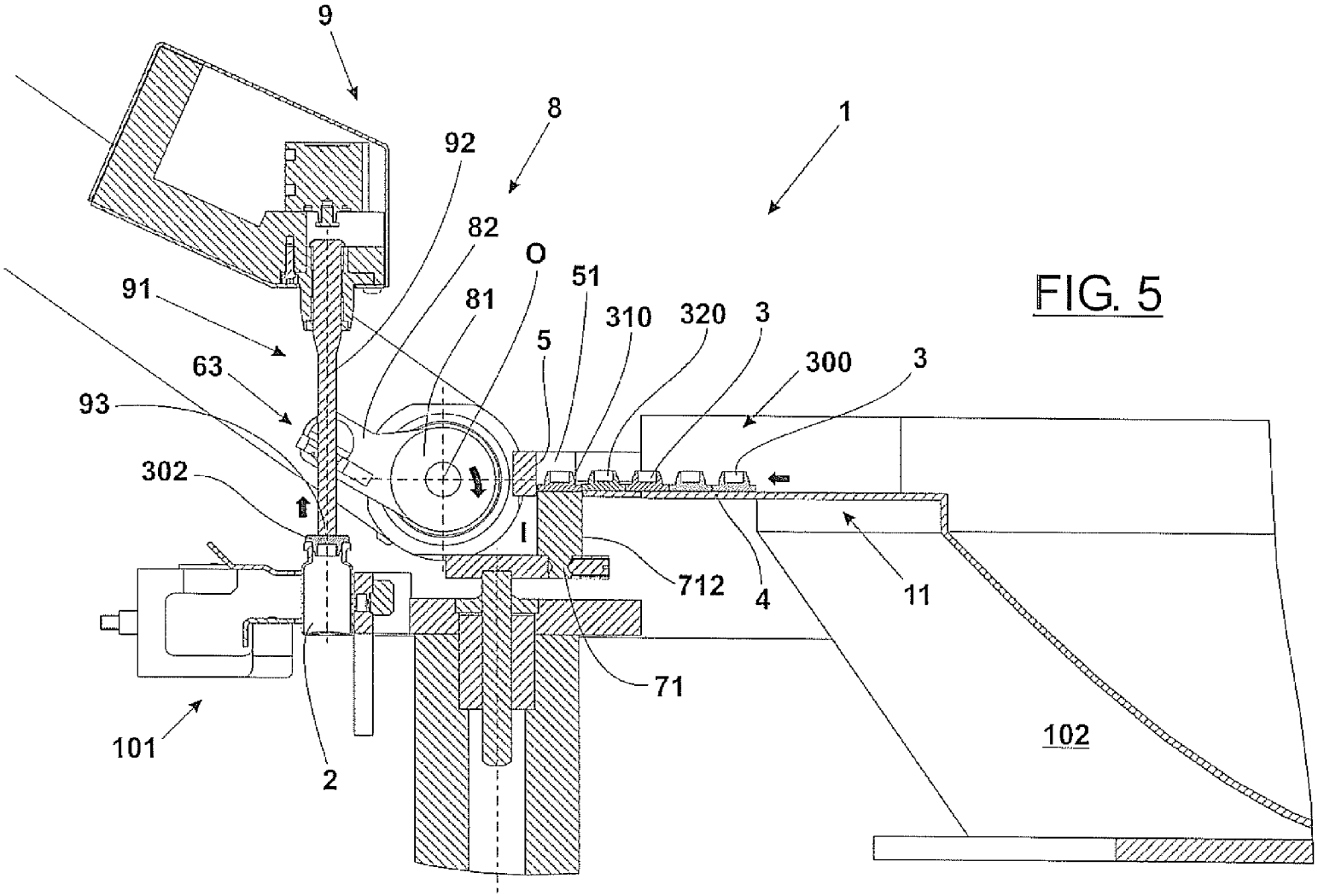
FIG. 5 is a lateral view in vertical section of the capping device, during application of the cap to a respective vial.

After capping a vial 2, the transfer mechanism obviously returns the housing 6, now without a cap 3, into the receiving position A in order to receive a further picked-up cap 30 (see FIG. 5).

In the release position R, the cap 30 retained in the housing 6 is brought to the vial 2 with an orientation where the inserting portion 301 of the cap 30 is facing the mouth 21 of the vial 2, as illustrated in FIG. 4.

To achieve a high working rate, i.e. rapidity or frequency of capping, the transfer mechanism 8 is activatable such that the housing 6 and the cap 30 it receives are tilted, preferably in a single motion, during passage from the receiving position A, in which they are above the collection point 121, to the release position R, in which they are above the mouth 21 of the respective vial 2.

To achieve the above in the constructionally simplest way (and the most economical too), the transfer mechanism 8 can comprise a body 81, activatable so as to rotate with respect to a horizontal axis O, and an arm 82 fixed projectingly to the body 81 and bearing the housing 6 (see FIGS. 1, 2, 3, 4 and 5).

When the body 81 is activated in rotation the housing 6 is moved, describing an arched trajectory of 180 degrees, in its passage from the housing position A to the release position R, and vice versa.

Thus, with a single rapid and secure movement, the caps 3 are time by time transferred from a pick-up zone 12 to the vials 2 to which they are destined, the whole, it is stressed, completed without any compromising at all of the total sterility of the respective inserting portions 31.

The transfer means 8 enable the caps 3 to be moved, rapidly and securely (from the point of the view of the sterility) between a pick-up zone 12, in which they rest on the head portion 32, with the inserting portion 31 facing upwards, and the crossing zone of the vials 2 in which the caps 3 will have the inserting portion 31 facing downwards, i.e. ready to insert in the respective vial 2.

There now follows a detailed description of the structure and functioning of the components of the capping device which carry out the capping true and proper (see in particular FIGS. 1, 2 and 5).

The pick-up and inserting means 13 of the device comprise at least a presser element 9, which is arranged with respect to the vial 2 in such a way as to be activatable to push on only the head portion 302 of a cap 30 which is arranged with the inserting portion 301 facing the mouth 21 of a given vial 2, so as to insert in the vial 2 at least a part of the inserting portion 301, through the mouth 21.

In this case, the transfer mechanism 8 is configured so as to be able to arrange the housing 6 in the release position R in which the presser element 9 can press only on the head portion 302 of the picked-up cap 30, thus extracting the cap from the housing 6 and then inserting the inserting portion 301 in the respective vial 2, at least partly.

The housing 6, in the release position R, is arranged above the mouth 21 of a vial 2 in such a way that the through-hole thereof is substantially concentric to the mouth 21 of the vial 2.

The presser element 9 preferably vertically comprises a vertically-movable cursor 91 having a stem 92 which terminates in a lower end 93 shaped so as to be able to press a cap 3 from above in a downwards direction, while contacting only the head portion 32 thereof.

Further, the stem 92 and the lower end 93 are dimensioned so as to be able to cross the through-hole 62 of the housing 6.

The stem 92 is preferably cylindrical and the lower end 93 is flat and horizontal. At the lower end 93 elastic resilient means can be provided, for example made of rubber, to enable a more uniform and/or less brusque pressure on the portion 32 of the head of the cap 3.

When the housing 6 is in the release position R, the presser element 9 is activated by causing the cursor 91 to slide downwards.

The above-mentioned lower end 93 presses on the cap 30, exerting on it a greater force than the force forming the connection between the head portion 302 and the internal edge 61 of the housing 6, which retains the cap 30 in the housing 6 by interference. The cap 30, once separated from the housing 6, continues to be pressed on the head portion 302 thereof such that the inserting portion 302 enters through the mouth 21 of the vial 2.

During this stage, the lower end 93 and the stem 92 of the cursor 91 can pass through the through-hole 62 of the housing 6.

In order to increase velocity, the cap 30 is preferably separated from the housing 6 and inserted in the vial 2 with a single movement.

With the aim of obtaining a velocity of frequency of capping that is even more rapid, the device 1 can be configured in order to be able to return the housing 6 into the receiving position A, in order to receive a further cap 30, while the presser element 9 is still inserting the inserting portion 301 into the mouth 21 of the vial 2 (as can be observed in FIG. 5).

The housing 6 preferably conforms to at least a passage 63 between an external edge 64 and the internal edge 61 (see also FIGS. 2A and 7), which passage 63 has greater dimensions than the stem 92 of the cursor 91.

The passage 63 is arranged in the housing 6 in such a way that after the housing 6 has been brought into the release position R, together with the picked-up cap 30, and after the cursor 91 has extracted the cap 30 from the housing 6, the body 81 of the transfer mechanism 8 can be activated in rotation so as to transfer the housing 6 towards the receiving position A, with the stem 92 of the cursor 91 passing freely through the passage 63.

The passage 63 is in practice an opening afforded in the part of the housing 6 which, if it were continuous and therefore without the passage 63, it would interfere with the stem 92 during the run towards the receiving position.

Any interference of this sort is therefore avoided.

In the above-described arrangement of the capping station 100, the passage 63 is arranged so as to face the linear vibrator 4, when the housing 6 is in the receiving position A, and thus is in the tilted position with respect to the rotation axis O, when the housing is in the release position R.

In order to cap more vials 2 contemporaneously, the device 1 preferably comprises one or more linear vibrators 4 configured so as to advance the caps 3 in several linear rows 300.

The device 1 also comprises a stop surface 5 and a pick-up point 121 for each linear row 300 of caps, as well as a pick-up element 7 and a housing 6 for each pick-up point 121 (see FIG. 1).

In order to cap a plurality of vials 2 with a single activation of the transfer mechanism 8, each housing 6 will be associated to the others so as to be solidly constrained thereto.

In detail, the housings 6 can be afforded in single bodies, for example a plate element.

Further, a movable cursor 91 can be provided for each housing 6.

A certain number of vials 2, for example four as in FIG. 1, stop at a given arrangement internally of the capping station 100 which comprises the device 1.

As they are the first in the row 300 which is brought towards the stop surface 5 by one or more linear vibrators 4, the caps 301 in the respective pick-up points 121 are picked up by one of the lifting members 71 and placed in a respective housing 6.

Each housing 6 with the respective picked-up cap 30 is tilted by the transfer mechanism 8 (which can be one alone for a plurality of housings 6, as in FIG. 1) and brought above the stationary vials 2.

At this point a cursor 91 for each cap, in FIG. 1 four in number, runs downwards, separates the cap 30 and the housing 6 and caps the stationary vials 2 on the transporter 101.

Then the transfer mechanism 8 returns the housings into the receiving position A and the transporter 101 carries the capped vials 2 beyond the capping station 100, at the same time making other vials 2 available for capping, and so on.

Lastly, the device 1 can be provided upstream with a dry-freezing station, which in certain cases is present in automatic machines for packing vials 2.

Freeze-drying is done, briefly, by evaporating the water comprised in the substance comprised in the vials, after partial capping.

In this case, the inserting portion of the caps affords a channel configured so as to enable the water vapor to exit from the vial 2.

After the vapor has exited, a final capping operation closes the vial 2 completely, in such a way that the channel is entirely internal of the vial 2 and thus does not enable any communication between the contents and the external environment.

Consequently, the capping device 1, and in particular the cursor 91 thereof, in the embodiments in which it is included, are activatable to partially cap the vials 2, with caps comprising the channel, in such a way that a fluid-dynamic communication is enabled between the inside of the vials 2 and the outside environment.

The above has been described by way of non-limiting example, and any eventual constructional variants are considered to fall within the ambit of protection of the present technical solution, as claimed herein below.

The invention claimed is:

1. A capping device for capping vials borne by a conveyor with caps, each cap having an inserting portion, shaped for insertion into a mouth of a vial, and a head portion, which remains externally on the vial after capping, the capping device comprising:

a pick-up zone configured for supporting and containing the caps by contacting only the head portion thereof;

a conveyor for supplying caps to the pick-up zone, configured for carrying the caps by contacting only a head portion thereof; and pick-up and inserting means configured and activatable for picking up at least one cap at a time from the pick-up zone, contacting only the head portion of the cap, and for transporting the picked-up cap, while retaining the cap only by the head portion thereof, to a respective vial to be capped, and for inserting at least a part of the inserting portion of the picked-up cap into the mouth of the vial;

wherein the pick-up and inserting means comprise:

at least one housing for receiving the picked-up cap and for retaining the cap releasably only by a head portion thereof, at least one pick-up element for collecting a cap from the pick-up zone and inserting the cap in the housing, and configured for picking up and carrying the cap while contacting only the head portion thereof, at least one transfer mechanism, to which the housing is fixed, activatable for moving the housing between a receiving position in which the housing can receive the picked-up cap and a release position in which the cap retained in the housing is brought to the vial, the transfer mechanism adjusting an orientation of the cap such that the inserting portion of the cap is facing the mouth of the vial;

at least one presser element arranged with respect to the vials so as to be activatable for pressing on only the head portion of a cap which is arranged with the inserting portion facing the mouth of the vial, and for inserting in the vial at least a part of the inserting portion, through the mouth;

wherein the transfer mechanism is configured for arranging the housing in the release position in which the presser element is movable to press on only the head portion of the picked-up cap, extracting the cap from the housing and inserting the inserting portion at least partly into the vial; and, wherein the housing has an internal edge which defines a through-hole, the through-hole having a width greater than a width of the inserting portion of the cap, the internal edge having a shape and dimensions for forming the through-hole such that the head portion of the cap is received and retained by an interference fit in the through-hole.

2. The capping device of claim 1, wherein the conveyor has at least one linear vibrator for carrying the caps resting on the respective head portions, with the respective inserting portions facing upwards, said linear vibrator configured for advancing the caps towards the pick-up zone, in at least one linear row with the caps being adjacent to one another, the caps advancing up to a stop surface, against which the head portion of a first cap of the linear row abuts.

3. The capping device of claim 2, wherein:

the pick-up zone has a pick-up point located between an internal end of the linear vibrator and the stop surface, and wherein the linear vibrator, the stop surface and the pick-up point are reciprocally arranged in such a way that the linear row of caps is maintained stationary both when the pick-up point is occupied by the first cap, against which head portion the head portion of an adjacent second cap abuts, and when the pick-up point is occupied by a movable abutting element, against which the head portion of the second cap abuts, and such that the linear row advances when the pick-up point is free of caps and of the abutting element.

4. The capping device of 3, further comprising:

a plurality of linear vibrators configured to advance the caps in several linear rows, a stop surface and a pick-up point provided for each linear row of caps, and wherein the pick-up and inserting means comprise: a pick-up element for each pick-up point, a housing for each pick-up point, the plurality of housings solidly constrained together, and a movable cursor for each housing.

5. The capping device of claim 1, wherein the internal edge of the housing comprises resilient means having a shape which releasably retains by interference the head portion of the cap.

6. The capping device of claim 1, wherein the transfer mechanism is activatable for tilting the housing and the cap received therein during passage from the receiving position to the release position.

7. The capping device of claim 6, wherein the transfer mechanism has a body activatable so as to be rotatable with respect to a horizontal axis, and an arm projectingly fixed to the body and bearing the housing, which, when the body is activated for rotation, is moved and describes an arched trajectory of 180 degrees, in passage thereof from the receiving position to the release position, and vice versa.

8. The capping device of claim 6, further comprising a vertical guide located about the pick-up point, and having internal walls forming a lateral abutment to the head portion of the first cap of the linear row, while the cap is raised by the pick-up element, the vertical guide having an opening facing towards the linear vibrator, the opening enabling the caps of the linear row to accede to the pick-up point.

9. A machine for packing vials including at least one capping device according to claim 1.

10. A capping device for capping vials borne by a conveyor with caps, each cap having an inserting portion, shaped for insertion into a mouth of a vial, and a head portion, which remains externally on the vial after capping, the capping device comprising:

a pick-up zone configured for supporting and containing the caps by contacting only the head portion thereof;

a conveyor for supplying caps to the pick-up zone, configured for carrying the caps by contacting only a head portion thereof; and pick-up and inserting means configured and activatable for picking up at least one cap at a time from the pick-up zone, contacting only the head portion of the cap, and for transporting the picked-up cap, while retaining the cap only by the head portion thereof, to a respective vial to be capped, and for inserting at least a part of the inserting portion of the picked-up cap into the mouth of the vial;

wherein the pick-up and inserting means comprise:

at least one housing for receiving the picked-up cap and for retaining the cap releasably only by a head portion thereof, at least one pick-up element for collecting a cap from the pick-up zone and inserting the cap in the housing, and configured for picking up and carrying the cap while contacting only the head portion thereof, at least one transfer mechanism, to which the housing is fixed, activatable for moving the housing between a receiving position in which the housing can receive the picked-up cap and a release position in which the cap retained in the housing is brought to the vial, the transfer mechanism adjusting an orientation of the cap such that the inserting portion of the cap is facing the mouth of the vial;

at least one presser element arranged with respect to the vials so as to be activatable for pressing on only the head portion of a cap which is arranged with the inserting portion facing the mouth of the vial, and for inserting in the vial at least a part of the inserting portion, through the mouth;

wherein the transfer mechanism is configured for arranging the housing in the release position in which the presser element is movable to press on only the head portion of the picked-up cap, extracting the cap from the housing and inserting the inserting portion at least partly into the vial;

wherein the transfer mechanism is activatable for tilting the housing and the cap received therein during passage from the receiving position to the release position; and, wherein the pick-up element comprises a lifting member having a top for supporting a cap and a lateral surface, the lifting member arranged at the pick-up point and being vertically movable between a lower arrangement in which the top thereof can restingly receive the head portion of the first cap of the linear row, contacting only the head portion, the head portion of the second cap abutting with the head portion of the first cap, and an upper arrangement in which the first cap, which occupies the pick-up point, is raised so that the first cap is insertable in a through-hole, defined by an internal edge of the housing, when the housing is in the receiving position, the inserting portion freely passing through the through-hole, the first cap contacting the internal edge of the housing only with the head portion, and wherein the lifting member constitutes the abutting element when the top of the lifting member is located superiorly of the linear vibrator, the head portion of the second cap of the row abutting against the lateral surface of the lifting member.

11. The capping device of claim 10, wherein the conveyor has at least one linear vibrator for carrying the caps resting on the respective head portions, with the respective inserting portions facing upwards, said linear vibrator configured for advancing the caps towards the pick-up zone, in at least one linear row with the caps being adjacent to one another, the caps advancing up to a stop surface, against which the head portion of a first cap of the linear row abuts.

12. The capping device of claim 10, wherein:

the pick-up zone has a pick-up point located between an internal end of the linear vibrator and the stop surface, and wherein the linear vibrator, the stop surface and the pick-up point are reciprocally arranged in such a way that the linear row of caps is maintained stationary both when the pick-up point is occupied by the first cap, against which head portion the head portion of an adjacent second cap abuts, and when the pick-up point is occupied by a movable abutting element, against which the head portion of the second cap abuts, and such that the linear row advances when the pick-up point is free of caps and of the abutting element.

13. The capping device of claim 10, wherein the internal edge of the housing comprises resilient means having a shape which releasably retains by interference the head portion of the cap.

14. The capping device of claim 10, wherein the transfer mechanism has a body activatable so as to be rotatable with respect to a horizontal axis, and an arm projectingly fixed to the body and bearing the housing, which, when the body is activated for rotation, is moved and describes an arched trajectory of 180 degrees, in passage thereof from the receiving position to the release position, and vice versa.

15. A machine for packing vials including at least one capping device according to claim 10.

16. A capping device for capping vials borne by a conveyor with caps, each cap having an inserting portion, shaped for insertion into a mouth of a vial, and a head portion, which remains externally on the vial after capping, the capping device comprising:

a pick-up zone configured for supporting and containing the caps by contacting only the head portion thereof;

a conveyor for supplying caps to the pick-up zone, configured for carrying the caps by contacting only a head portion thereof; and pick-up and inserting means configured and activatable for picking up at least one cap at a time from the pick-up zone, contacting only the head portion of the cap, and for transporting the picked-up cap, while retaining the cap only by the head portion thereof, to a respective vial to be capped, and for inserting at least a part of the inserting portion of the picked-up cap into the mouth of the vial;

wherein the pick-up and inserting means comprise:

at least one housing for receiving the picked-up cap and for retaining the cap releasably only by a head portion thereof, at least one pick-up element for collecting a cap from the pick-up zone and inserting the cap in the housing, and configured for picking up and carrying the cap while contacting only the head portion thereof, at least one transfer mechanism, to which the housing is fixed, activatable for moving the housing between a receiving position in which the housing can receive the picked-up cap and a release position in which the cap retained in the housing is brought to the vial, the transfer mechanism adjusting an orientation of the cap such that the inserting portion of the cap is facing the mouth of the vial;

at least one presser element arranged with respect to the vials so as to be activatable for pressing on only the head portion of a cap which is arranged with the inserting portion facing the mouth of the vial, and for inserting in the vial at least a part of the inserting portion, through the mouth;

wherein the transfer mechanism is configured for arranging the housing in the release position in which the presser element is movable to press on only the head portion of the picked-up cap, extracting the cap from the housing and inserting the inserting portion at least partly into the vial;

wherein the transfer mechanism is activatable for tilting the housing and the cap received therein during passage from the receiving position to the release position;

wherein the transfer mechanism has a body activatable so as to be rotatable with respect to a horizontal axis, and an arm projectingly fixed to the body and bearing the housing, which, when the body is activated for rotation, is moved and describes an arched trajectory of 180 degrees, in passage thereof from the receiving position to the release position, and vice versa; and, wherein the presser element of the pick-up and inserting means comprises a vertically-movable cursor having a stem which terminates in a lower end shaped for pressing a cap from above in a downwards direction while only contacting the head portion thereof, the stem and the lower end being dimensioned for passing through a through-hole of the housing.

17. The capping device of claim 16, wherein the housing has at least one passage between an external edge thereof and the internal edge thereof, which defines the through-hole, the passage being of greater dimensions than the stem of the cursor, and being arranged so that after the housing has been brought into the release position, together with the picked-up cap, and after the cursor has extracted the cap from the housing by pressing the head portion, the body of the transfer mechanism is activatable in rotation for transferring the housing towards the receiving position, with the stem of the cursor passing freely through the passage of the housing.

18. The capping device of claim 16, wherein the conveyor has at least one linear vibrator for carrying the caps resting on the respective head portions, with the respective inserting portions facing upwards, said linear vibrator configured for advancing the caps towards the pick-up zone, in at least one linear row with the caps being adjacent to one another, the caps advancing up to a stop surface, against which the head portion of a first cap of the linear row abuts.

19. The capping device of claim 18, wherein:

the pick-up zone has a pick-up point located between an internal end of the linear vibrator and the stop surface, and wherein the linear vibrator, the stop surface and the pick-up point are reciprocally arranged in such a way that the linear row of caps is maintained stationary both when the pick-up point is occupied by the first cap, against which head portion the head portion of an adjacent second cap abuts, and when the pick-up point is occupied by a movable abutting element, against which the head portion of the second cap abuts, and such that the linear row advances when the pick-up point is free of caps and of the abutting element.

20. The capping device of claim 16, wherein the internal edge of the housing comprises resilient means having a shape which releasably retains by interference the head portion of the cap.

* * * * *